US009429153B2

(12) United States Patent
Dreher

(10) Patent No.: US 9,429,153 B2
(45) Date of Patent: Aug. 30, 2016

(54) HYDRAULIC DUAL AXIAL PISTON MACHINE

(75) Inventor: Herbert Dreher, Fountain Inn, SC (US)

(73) Assignee: Robert Bosch GmbH, Stuttgart (DE)

( * ) Notice: Subject to any disclaimer, the term of this patent is extended or adjusted under 35 U.S.C. 154(b) by 673 days.

(21) Appl. No.: 13/808,258

(22) PCT Filed: Jun. 24, 2011

(86) PCT No.: PCT/DE2011/001367
§ 371 (c)(1),
(2), (4) Date: Mar. 22, 2013

(87) PCT Pub. No.: WO2012/010137
PCT Pub. Date: Jan. 26, 2012

(65) Prior Publication Data

US 2013/0209284 A1 Aug. 15, 2013

(30) Foreign Application Priority Data

Jul. 8, 2010 (DE) ..... 10 2010 026 454

(51) Int. Cl.

| | |
|---|---|
| ***F04B 49/12*** | (2006.01) |
| ***F03C 1/40*** | (2006.01) |
| ***F04B 1/32*** | (2006.01) |
| ***F04B 49/00*** | (2006.01) |
| ***F04B 49/08*** | (2006.01) |

(52) U.S. Cl.

CPC ..... *F04B 49/12* (2013.01); *F03C 1/0686* (2013.01); *F04B 1/32* (2013.01); *F04B 49/002* (2013.01); *F04B 49/08* (2013.01)

(58) Field of Classification Search

CPC ..... F04B 1/32; F04B 1/324; F04B 49/002; F04B 49/08; F04B 49/12; F04B 1/2007; F04B 1/2014; F04B 1/2078; F03C 1/0686

USPC ..... 417/218, 269, 222.1; 92/13, 12.2, 71; 91/505

See application file for complete search history.

(56) References Cited

U.S. PATENT DOCUMENTS

| | | | | |
|---|---|---|---|---|
| 6,030,182 A * | 2/2000 | Voigt | ..... | F04B 1/324 417/222.1 |
| 2008/0060510 A1* | 3/2008 | Achten | ..... | F04B 1/2007 92/13 |
| 2010/0199838 A1* | 8/2010 | Krebs | ..... | F04B 1/2014 91/505 |

FOREIGN PATENT DOCUMENTS

| | | | | |
|---|---|---|---|---|
| DE | 1 052 766 | 3/1959 | | |
| DE | 1 450 821 | 5/1970 | | |
| DE | 10 2005 037 618 A1 | 11/2006 | | |
| DE | WO 2008138604 A2 * | 11/2008 | ..... | F04B 1/2078 |
| EP | 1 990 559 A2 | 11/2008 | | |

OTHER PUBLICATIONS

WO2008/138604; Dreher, Herbert; Axial Piston Machine; Nov. 2, 2008.*

WO 2008/138604 A2 (by Dreher, Krebs and Beder) English Translation with annotations.*

International Search Report corresponding to PCT Application No. PCT/DE2011/001367, mailed Feb. 8, 2012 (German and English language document) (6 pages).

* cited by examiner

*Primary Examiner* — Devon Kramer
*Assistant Examiner* — Connor Tremarche
(74) *Attorney, Agent, or Firm* — Maginot, Moore & Beck LLP

(57) ABSTRACT

A hydraulic dual axial piston machine includes a first driving unit and a second driving unit arranged one behind the other in the direction of the axis of a drive shaft and oriented opposite each other. The first and second driving units each have a respective swashplate and single actuating piston. The first and second actuating pistons exert load on a pivot cradle in a functionally identical manner to increase or decrease a pivot angle of the respective swashplate. The first and second actuating pistons are spaced apart from a central plane of the swashplates which extends through the axis of the drive shaft such that dimensions of a housing in the direction of the pivot axes of the swashplates are minimally influenced.

12 Claims, 5 Drawing Sheets

HYDRAULIC DUAL AXIAL PISTON MACHINE

This application is a 35 U.S.C. §371 National Stage Application of PCT/DE2011/001367, filed on Jun. 24, 2011, which claims the benefit of priority to Serial No. DE 10 2010 026 454.7, filed on Jul. 8, 2010 in Germany, the disclosures of which are incorporated herein by reference in their entirety.

BACKGROUND

The disclosure relates to a hydraulic dual axial piston machine having a first drive unit and having a second drive unit which are arranged one behind the other in the direction of the axis of a drive shaft and so as to be oriented oppositely to one another. The first drive unit is equipped with a first swashplate, which for the purpose of varying the inclination relative to the axis of the drive shaft can be pivoted about a first pivot axis, and with a single first actuating piston, which extends at least approximately parallel to the axis of the drive shaft and which, at a first end, engages on the first swashplate for the purpose of pivoting the latter in one direction and which, at a second end, delimits an actuating chamber into which control fluid flows for the purpose of pivoting the first swashplate in one direction and out of which control fluid can be displaced in the event of a pivoting movement of the first swashplate in the other direction. The second drive unit is equipped with a second swashplate, which for the purpose of varying the inclination relative to the axis of the drive shaft can be pivoted about a second pivot axis parallel to the first pivot axis, and with a single second actuating piston, which extends at least approximately parallel to the axis of the drive shaft and which, at a second end, engages on the second swashplate for the purpose of pivoting the latter in a functionally identical manner to the first actuating piston on the first swashplate and which, at a second end, delimits an actuating chamber into which control fluid flows for the purpose of pivoting the second swashplate in one direction and out of which control fluid can be displaced in the event of a pivoting movement of the second swashplate in the other direction.

A dual pump of said type, with a back-to-back arrangement of the two component pumps, is known from practice and from the repair manual RDE 93100-11-R/07/07 from Bosch Rexroth AG. Here, the two regulating valves for the adjustment of the component pumps are arranged, on a central part of the housing, in the same plane and so as to be offset both in the longitudinal direction and also in a transverse direction. Furthermore, the regulating valves are oriented oppositely to one another, such that for each regulating valve, the arrangement with respect to the component pump with which it is associated is the same. The actuating pistons are also offset with respect to one another as viewed perpendicularly to the longitudinal direction of the dual pump. This means that the position of the actuating pistons with respect to the exertion of force on the two swashplates by the pump pistons presently performing a delivery stroke is different in the case of one swashplate than in the case of the other swashplate.

The disclosure is based on the object of further developing a hydraulic dual axial piston machine of the known type such that substantially identical conditions are present with regard to the two drive units.

This is achieved in that the first actuating piston and the second actuating piston, which exert load on the pivot cradle in a functionally identical manner and which thus either both act in the direction of an increase or both act in the direction of a decrease in the pivot angle of the respective swashplate, are arranged, so as to be spaced apart from a central plane of the swashplates which is perpendicular to the pivot axes and which extends through the axis of the drive shaft, at least approximately in alignment with one another. Identical conditions thus prevail for both drive units with regard to the locations at which force is exerted on the swashplates by the pump pistons and by the first and second actuating pistons. As a result of the arrangement spaced apart from a plane which is perpendicular to the pivot axes and which extends through the axis of the drive shaft, the actuating pistons are situated within the housing in such a region that the maximum dimensions of the housing in the direction of the pivot axes of the swashplates, and perpendicular thereto, are influenced at most to a small extent.

Advantageous embodiments of a hydraulic dual axial piston machine according to the disclosure emerge from the description below.

SUMMARY

If the dual axial piston machine has, for each drive unit, an actuating piston which acts as a pivoting-out piston and to the actuating chamber of which pressure medium is supplied in the event of a pivoting movement of the corresponding swashplate in one direction, and an actuating piston which acts as a pivoting-in piston and to the actuating chamber of which pressure medium is supplied in the event of a pivoting movement of the corresponding swashplate in the opposite direction, it is advantageously the case that the two pivoting-out pistons are arranged in alignment with one another and the two pivoting-in pistons are arranged in alignment with one another.

In axial piston machines, feedback elements are often provided, the purpose of which is to input the pivot angle of a swashplate alone, or together with the high pressure, into the regulating means of the axial piston machine. It is known for such a feedback element to be provided on an actuating piston, because the position of the actuating piston correlates with the pivot angle of the swashplate.

A feedback element of said type is provided in particular if the axial piston machine is to be adjusted in a torque-regulated manner, or proportionally to an input signal. In the case of torque regulation, the feedback element is also provided with a small piston which is subjected to the working pressure and which, depending on the position of the actuating piston and thus of the swashplate, engages on a lever at a different distance from an axis of rotation and exerts a torque on said lever. The valve piston of a regulating valve is supported counter to said torque on the same arm, or on a second arm, of the lever at a fixed distance from the axis of rotation, said valve piston being subjected to a constant or remote-controlled variable force which seeks to increase the swept volume. The swept volume of the axial piston machine is then set in each case such that torque equilibrium prevails at the lever.

In the case of a proportional adjustment of the swept volume, the feedback element varies the preload of a spring which exerts load on a valve piston of the regulating valve, said valve piston being acted on counter to the spring by an input force generated predominantly by an electromagnet or a hydraulic pressure. Depending on the magnitude of the input force, the spring force and thus the position of the actuating piston and thus of the swashplate must vary such that, when the valve piston is in the zero position, the spring force and input force maintain the equilibrium.

For a dual axial piston machine, it is known for there to be arranged on the first actuating piston a first elongate feedback element by means of which the position of the first actuating piston and thus the pivot angle of the first swashplate is input into a controller of a first regulating valve, and for there to be arranged on the second actuating piston a second elongate feedback element by means of which the position of the second actuating piston and thus the pivot angle of the second swashplate is input into a controller of a second regulating valve. According to one embodiment, it is now the case that the first feedback element and the second feedback element are in each case situated such that the longitudinal axis of the first feedback element and the longitudinal axis of the first actuating piston span a first plane and the longitudinal axis of the second feedback element and the longitudinal axis of the second actuating piston span a second plane which differs from the first plane. The positioning of the feedback elements is determined for example by a guide in the housing or on the respective regulating valve or by means of a particular arrangement on the actuating piston if the latter is not rotatable about its longitudinal axis.

It is provided in particular, according to one embodiment, that the first feedback element and the second feedback element are situated such that the first plane and the second plane are at least approximately perpendicular to one another. Small deviations from the mutually perpendicular profile of the two planes may arise for example as a result of a pivoting movement of the actuating piston which is superposed on the linear movement.

It is now particularly preferable, according to another embodiment, for the first plane to be perpendicular to the pivot axes of the swashplates, while the second plane runs parallel to the pivot axes of the swashplates.

According to another embodiment, the two feedback elements are of different lengths. One feedback element interacts, as already described above, with one regulating valve. Different lengths of the feedback elements now make it possible to compensate for different housing dimensions and resulting different spacings, resulting from the mounting configuration, between the regulating valves and the actuating pistons.

If it is the intention for the dual axial piston machine to be of very short construction, it may be the case, if the regulating valves are arranged spatially close to the actuating pistons and the actuating pistons are arranged in alignment, that the accessibility to adjusting devices on the regulating valves is associated with difficulties, even if the regulating valves are arranged more or less in alignment with one another. It may therefore be expedient if, according to one embodiment, the mounting surfaces for the regulating valves on the outside of the housing of the dual axial piston pump are rotated relative to one another about the axis of the drive shaft. This may also be advantageous if no feedback element is provided.

For different housing dimensions, the two planes which are parallel to the axis of the drive shaft and in which the mounting surfaces are situated may have different spacings to the axis of the drive shaft.

It is preferable for the plane in which one mounting surface is situated to run parallel to the pivot axes of the swashplates and to the axis of the drive shaft, and for the plane in which the second mounting surface is situated to be perpendicular to the pivot axes of the swashplates.

If feedback elements are provided, then it is preferable for the first mounting surface to run at least approximately perpendicular to the longitudinal axis of the first feedback element and for the second mounting surface to run at least approximately perpendicular to the longitudinal axis of the second feedback element. Equivalent valve axes of the two regulating valves are offset with respect to one another in the circumferential direction of the housing.

An exemplary embodiment of a hydraulic dual axial piston machine according to the disclosure is illustrated in the drawings. The disclosure will now be explained in more detail on the basis of the figures of said drawings.

DETAILED DESCRIPTION

Figure 1:
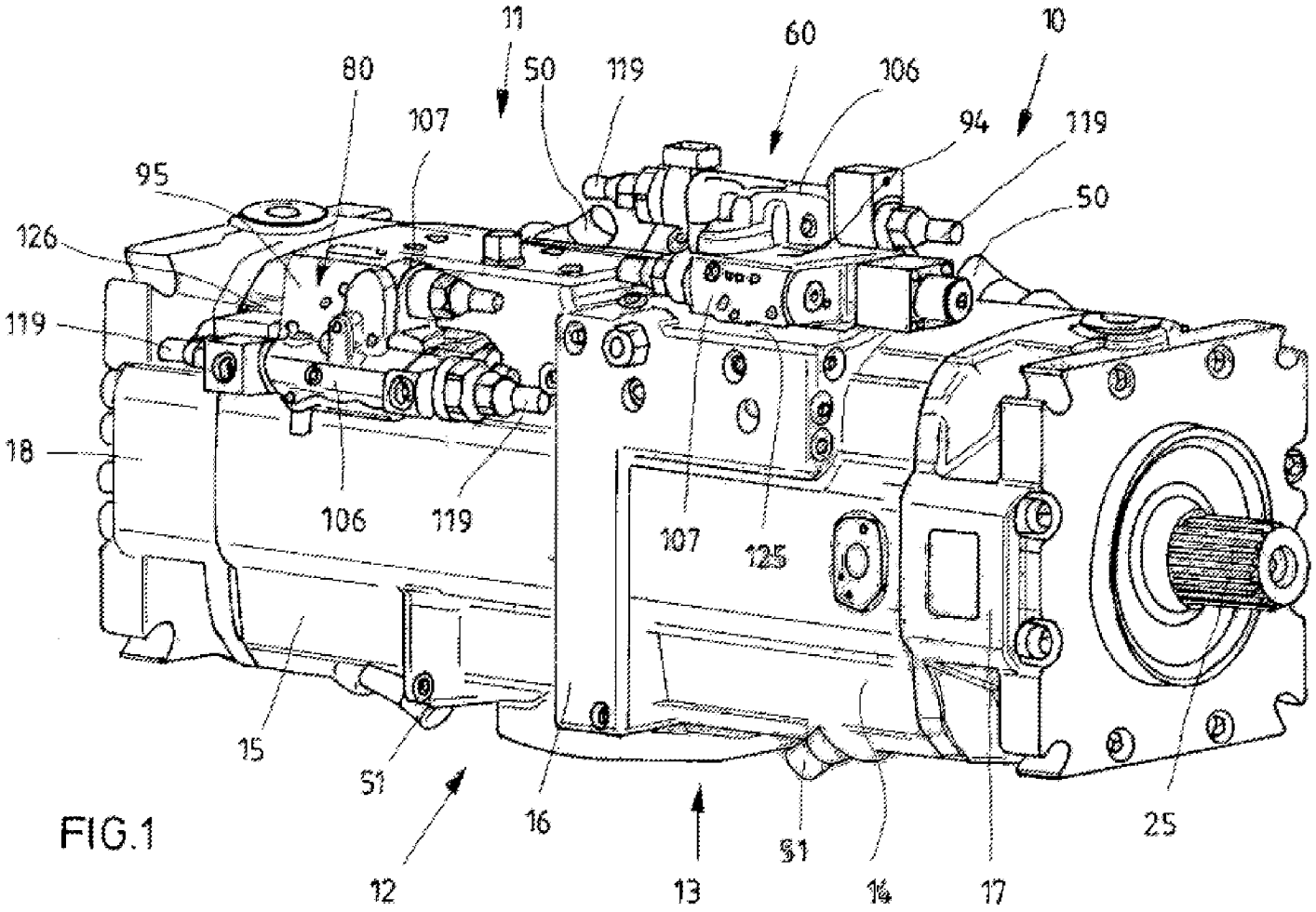
FIG. 1 shows an external view of a dual pump, one component pump of which has an actuating piston with feedback element mounted in the manner according to the disclosure.

In the dual axial piston pump shown, it is the case not simply that two single axial piston pumps are mounted on one another in a back-to-back position, but rather that a common main part 13 of a housing 12 is provided for the two component pumps 10 and 11. The main part 13 can be regarded as being constructed from two housing pots 14 and 15 which, with the bases thereof, form a single central block 16 from which the walls of the housing pots project in opposite directions. At the free edge, the housing pot 14 is closed off by a cover 17, and the housing pot 15 is closed off by a cover 18. Within each of the two spaces closed off in each case by a housing pot and a cover there is situated a drive unit 19 or 20 respectively of a component pump. Each drive unit includes a drive shaft 21 or 22 respectively. Said two drive shafts have a common axis 23 and are rotatably mounted in each case in one of the covers and in the central block or in an insert ring (not illustrated in any more detail) which is inserted into said central block. Approximately centrally, the two drive shafts 21 and 22 are coupled to one another in a rotationally conjoint manner by means of an internally toothed coupling sleeve 24 into which they protrude with externally toothed shaft stubs. The drive shaft 21 extends through the cover 17 and has, on the outside, an externally toothed drive journal 25 for coupling to a drive motor, for example a diesel engine.

Here, a "back to back" arrangement means that the two drive units 19 and 20 of the two component pumps 10 and 11 are, in terms of basic construction, constructed mirror-symmetrically with respect to a plane running in the region of the central block 16 and perpendicularly to the axis 23.

The drive unit 19 includes a cylinder drum 30 which is connected rotationally conjointly to the drive shaft 21 and in which bores running in the axial direction are situated so as to be distributed at equal angular intervals about the axis 23, each of which bores receives a pump piston 31. The pump pistons 31 project at one end side out of the cylinder drum 30 and bear via slide shoes 32 against a swashplate 33. During the suction stroke in which the working chambers behind the pump pistons are connected to a tank line, to a charge-pressure line which conducts a charge pressure of for example 3 bar, or to a low-pressure line which conducts a feed pressure of for example 30 bar, the slide shoes are held against the swashplate 33, and pulled out of the bores of the cylinder drum 30, by a retaining plate 34 which, at bores, engages behind shoulders of the slide shoes. The retaining plate in turn is held against the swashplate by two hold-down segments 35 of said swashplate.

The swashplate 33 has, centrally, an aperture in which the drive shaft 21 extends through the swashplate. On each side of the drive shaft, the swashplate 33 has a convex bearing surface 36 of circular cylindrical shape. Both bearing surfaces have the same central axis which constitutes the pivot axis 37 of the swashplate. By means of the bearing surfaces, the swashplate can be pivoted, in corresponding bearing shells of the cover 17, about the pivot axis 37.

The drive unit 20 includes a cylinder drum 40 which is connected rotationally conjointly to the drive shaft 22 and in which bores running in the axial direction are situated so as to be distributed at equal angular intervals about the axis 23, each of which bores receives a pump piston 41. The pump pistons 41 project at one end side out of the cylinder drum 40 and bear via slide shoes 42 against a swashplate 43. During the suction stroke in which the working chambers at the pump pistons are connected to a tank line, to a charge-pressure line which conducts a charge pressure of for example 3 bar, or to a low-pressure line which conducts a feed pressure of for example 30 bar, the slide shoes are held against the swashplate 43, and pulled out of the bores of the cylinder drum 30, by a retaining plate which, at bores, engages behind shoulders of the slide shoes. The retaining plate in turn is held against the swashplate by two hold-down segments 45 of said swashplate.

The swashplate 43 has, centrally, an aperture in which the drive shaft 22 extends through the swashplate. On each side of the drive shaft, the swashplate 43 has a convex bearing surface 46 of circular cylindrical shape. Both bearing surfaces have the same central axis which constitutes the pivot axis 47 of the swashplate. By means of the bearing surfaces, the swashplate can be pivoted, in corresponding bearing shells of the cover 18, about the pivot axis 47. The pivot axes 37 and 47 intersect the shaft axis 23.

The two end positions of each swashplate 33, 43 are predefined by means of stop screws 50 and 51 screwed into the housing main part 13.

The axes of the stop screws run in a skewed configuration with respect to the shaft axis 23. The stop screw 50 of one component pump is situated on one side, and the stop screw 51 of said component pump is situated on the other side, of a plane spanned by the axes 23 and 37 or 47 respectively, and said stop screws are situated at equal distances from the shaft axis 23, resulting in a type of diagonal arrangement of the two stop screws at diagonally opposite corners of the housing 12 which has a square basic cross-sectional shape. The stop screw 50 of one component pump interacts with a stop surface on one hold-down means 35 or 45 respectively, and the other stop screw 51 interacts with a stop surface on the other hold-down means 35 or 45 respectively of a swashplate.

Figure 2:
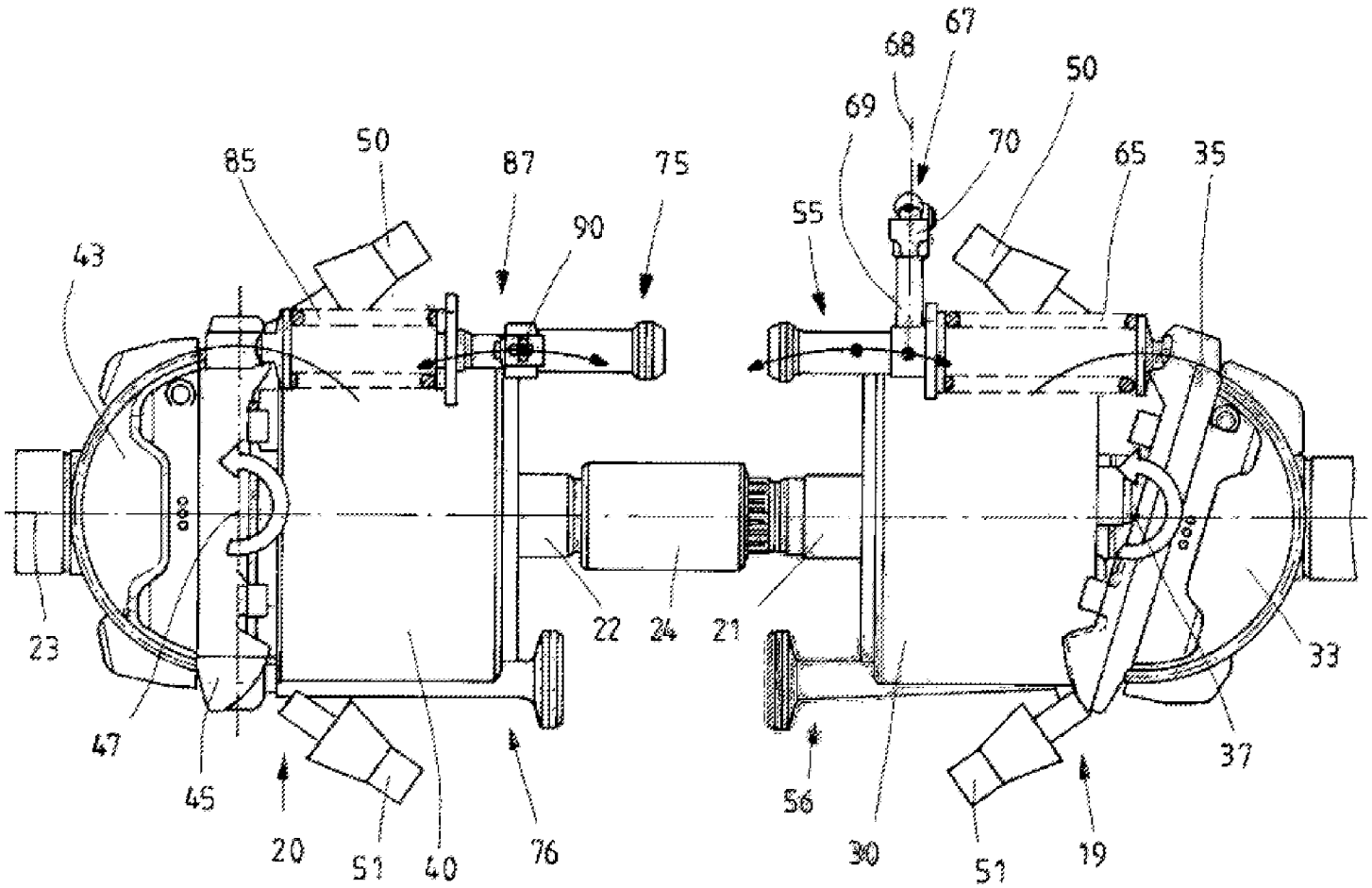
FIG. 2 shows a plan view of only the drive units of the dual pump in the direction of the pivot axes of the two swashplates and perpendicular to the axis of the two drive shafts.
Figure 3:
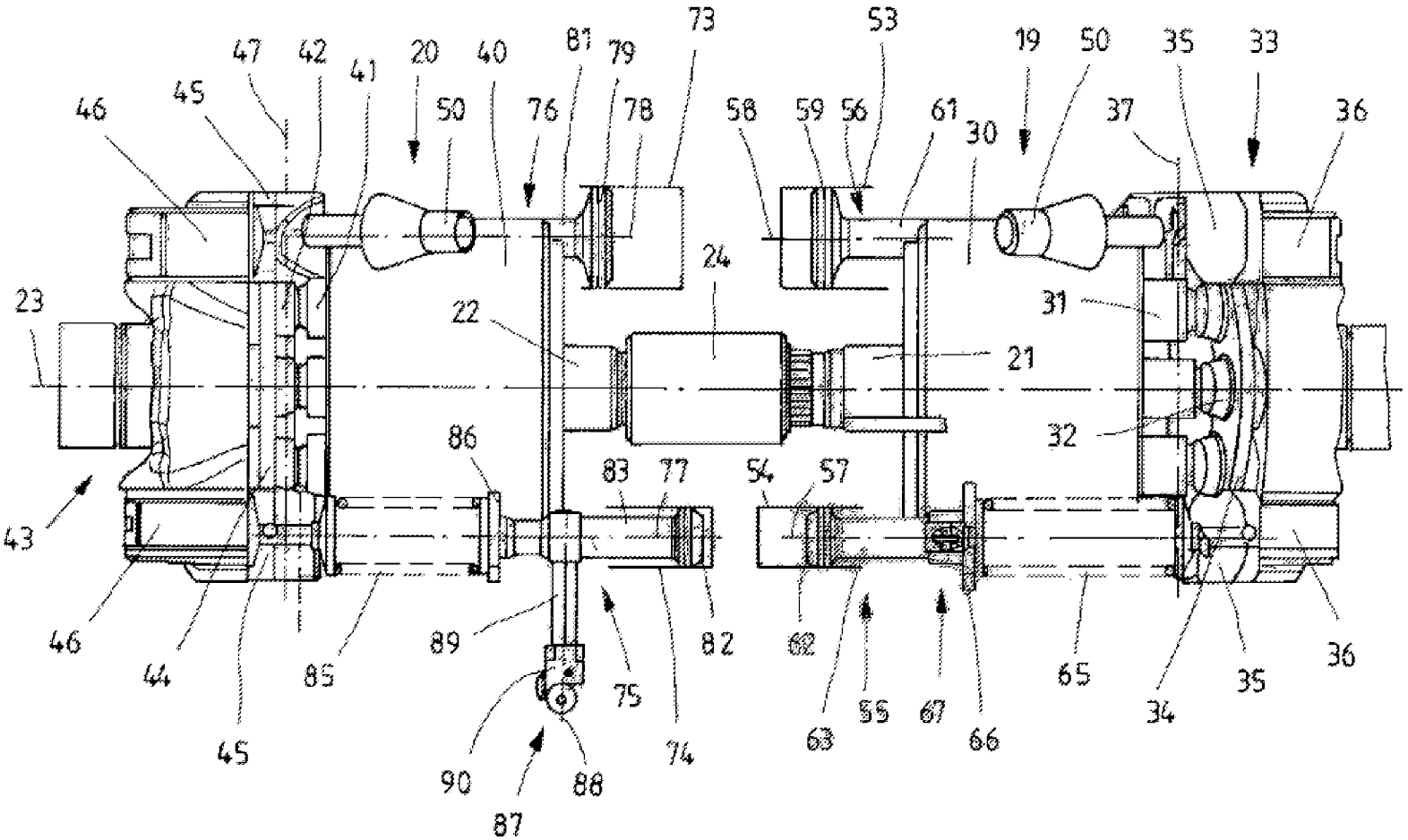
FIG. 3 shows a plan view of only the drive units of the dual pump in a direction perpendicular to the pivot axes of the two swashplates and perpendicular to the axis of the two drive shafts.

In FIGS. 2 and 3, the swashplate 43 of the component pump 11 is shown in one end position, specifically in or close to the zero position in which it bears against the stop screw 50 associated therewith and in which that surface of the swashplate against which the slide shoes 42 bear is perpendicular or approximately perpendicular to the shaft axis 23. In said position of the swashplate 43, the pump pistons 41 do not perform a stroke as the cylinder drum 40 rotates. The swept volume of the component pump 11, that is to say the amount of pressure medium delivered by the component pump per revolution, is then zero. The swashplate 33 of the other component pump 10 is pivoted to a maximum extent and bears against the associated stop screw 51. In said position of a swashplate, the swept volume of a component pump is then at a maximum.

For the adjustment of the swashplate 33 into any desired intermediate position between the two end positions, there are provided, as actuating pistons, a pivoting-out piston 55 and a pivoting-in piston 56 which are arranged in the two corners, which are not occupied by the stop screws 50 and 51, of the housing 12 and the longitudinal axes 57 and 58 of which run parallel to the shaft axis 23 when the swashplate 33 is in the zero position. The pivoting-in piston 56 has a piston collar 59 with a relatively large effective surface, by means of which said pivoting-in piston is guided sealingly, and in such a way that the sealing action is maintained, in a slightly pivotable manner in a sleeve 53 which is fixed with respect to the housing and arranged parallel to the shaft axis. In the sleeve, the piston collar delimits an actuating chamber to which pressure medium is supplied via a regulating valve 60 shown in FIG. 1 for the purpose of decreasing the pivot angle of the swashplate 33 and from which pressure medium can be discharged via the regulating valve 60 when the pivot angle of the swashplate 33 is to be increased.

Formed in one piece with the piston collar 59 is a piston rod 61 which is articulatedly connected to a hold-down means 35 and thus to the swashplate 33.

The pivoting-out piston 55 also has a piston collar 62 by means of which it is guided sealingly, and in such a way that the sealing action is maintained, in a slightly pivotable manner in a sleeve 54 which is fixed with respect to the housing and arranged parallel to the shaft axis. In the sleeve, the piston collar 62 delimits an actuating chamber which, in a way which is not illustrated, is subjected permanently to the pump pressure of the component pump 10. The cross-sectional area of the piston collar 62 is significantly smaller than that of the piston collar 59, such that a pressure significantly lower than the pump pressure in the actuating chamber delimited by the piston collar 59 is sufficient to pivot the swashplate 33 back counter to the action of the pivoting-out piston 55. Formed in one piece with the piston collar 62 is a piston rod 63 which is articulatedly connected to the other hold-down means 35 of the swashplate 33.

In order that the swashplate 33 assumes the position of maximum pivot angle as a preferential position in the unpressurized state, there interacts with the pivoting-out piston 55 a pivoting-out spring 65 formed as a helical compression spring, said spring being pushed onto the piston rod 63 and being supported at one side on a shoulder, situated close to the hold-down means 35, of the pivoting-out piston 55 and being supported at the other side on a spring plate 66, which surrounds the piston rod 63, on the housing 12.

Via the pivoting-out piston 55, the pivoting-out spring 65 exerts load on the swashplate 33 in the direction of larger pivot angles.

In that length of the piston rod 63 which is always situated between the piston collar 62 and the spring plate 66, the piston rod has a thickened region with a transverse bore in which an elongate feedback element 67 is fastened. The position of the feedback element 67 on the piston rod 63 is such that the maximum retraction of the piston collar into the corresponding sleeve in order to attain the zero position of the swashplate 33 is not hindered, nor does the feedback element 67 abut against the spring plate 66 when the swashplate is at the maximum pivot angle. In the housing main part there is situated a corresponding cutout in which the feedback element 67 can move freely. A longitudinal axis 68 of the feedback element is perpendicular to the longitudinal axis of the pivoting-out piston 55. The feedback element has a housing 69 which, at its distal end remote from the piston rod 63, is formed as a dihedron 70 and is guided with the latter in a slot of the regulating valve 60. Said guidance and the position of the regulating valve 60 on the housing 12 have the result that, in the component pump 10, the feedback element 67 is positioned such that the longitudinal axis 68 thereof and the longitudinal axis of the pivoting-out piston 55 span a plane which runs perpendicular to the pivot axis 37 of the swashplate 33.

For the adjustment of the swashplate 43 of the component pump 11 into any desired intermediate position between the two end positions, there are provided, as actuating pistons, a pivoting-out piston 75 and a pivoting-in piston 76 which are arranged in the two corners, which are not occupied by the stop screws 50 and 51, of the housing 12 and the longitudinal axes 77 and 78 of which run parallel to the shaft axis 23, and are aligned with the longitudinal axes 57 and 58 of the corresponding actuating pistons of the component pump 10, when the swashplate 43 is in the zero position. The two pivoting-in pistons 56 and 76 and the two pivoting-out pistons 55 and 75 are identical to one another. Accordingly, the pivoting-in piston 76 has a piston collar 79 with a relatively large effective surface, by means of which said pivoting-in piston is guided sealingly, and in such a way that the sealing action is maintained, in a slightly pivotable manner in a sleeve which is fixed with respect to the housing and arranged parallel to the shaft axis. In the sleeve, the piston collar delimits an actuating chamber to which pressure medium is supplied via a regulating valve 80 shown in FIGS. 1 and 4 for the purpose of decreasing the pivot angle of the swashplate 43 and from which pressure medium can be discharged via the regulating valve 80 when the pivot angle of the swashplate 43 is to be increased.

Formed in one piece with the piston collar 79 is a piston rod 81 which is articulatedly connected to a hold-down means 45 and thus to the swashplate 43.

The pivoting-out piston 75 also has a piston collar 82 by means of which it is guided sealingly, and in such a way that the sealing action is maintained, in a slightly pivotable manner in a sleeve 74 which is fixed with respect to the housing and arranged parallel to the shaft axis. In the sleeve, the piston collar 82 delimits an actuating chamber which, in a way which is not illustrated, is subjected permanently to the pump pressure of the component pump 11. The cross-sectional area of the piston collar 82 is significantly smaller than that of the piston collar 79, such that a pressure significantly lower than the pump pressure in the actuating chamber delimited by the piston collar 79 is sufficient to pivot the swashplate 43 back counter to the action of the pivoting-out piston 75. Formed in one piece with the piston collar 82 is a piston rod 83 which is articulatedly connected to the other hold-down means 45 of the swashplate 43.

In order that the swashplate 43 assumes the position of maximum pivot angle as a preferential position in the unpressurized state, there interacts with the pivoting-out piston 75 a pivoting-out spring 85 formed as a helical compression spring, said spring being pushed onto the piston rod 83 and being supported at one side on a shoulder, situated close to the hold-down means 45, of the pivoting-out piston 75 and being supported at the other side on a spring plate 86, which surrounds the piston rod 83, on the housing 12. Via the pivoting-out piston 75, the pivoting-out spring 85 exerts load on the swashplate 43 in the direction of larger pivot angles.

In that length of the piston rod 83 which is always situated between the piston collar 82 and the spring plate 86, the piston rod has a thickened region with a transverse bore in which an elongate feedback element 87 is fastened. The position of the feedback element 87 on the piston rod 83 is such that the maximum retraction of the piston collar into the corresponding sleeve in order to attain the zero position of the swashplate 43 is not hindered, nor does the feedback element abut against the spring plate 86 when the swashplate is at the maximum pivot angle. In the housing main part there is situated a corresponding cutout in which the feedback element 87 can move freely. The feedback element 87 has a housing 89 which, at its distal end remote from the piston rod 83, is formed as a dihedron 90 and is guided with the latter in a slot 91 of the regulating valve 80 (see FIG. 4).

Figure 4:
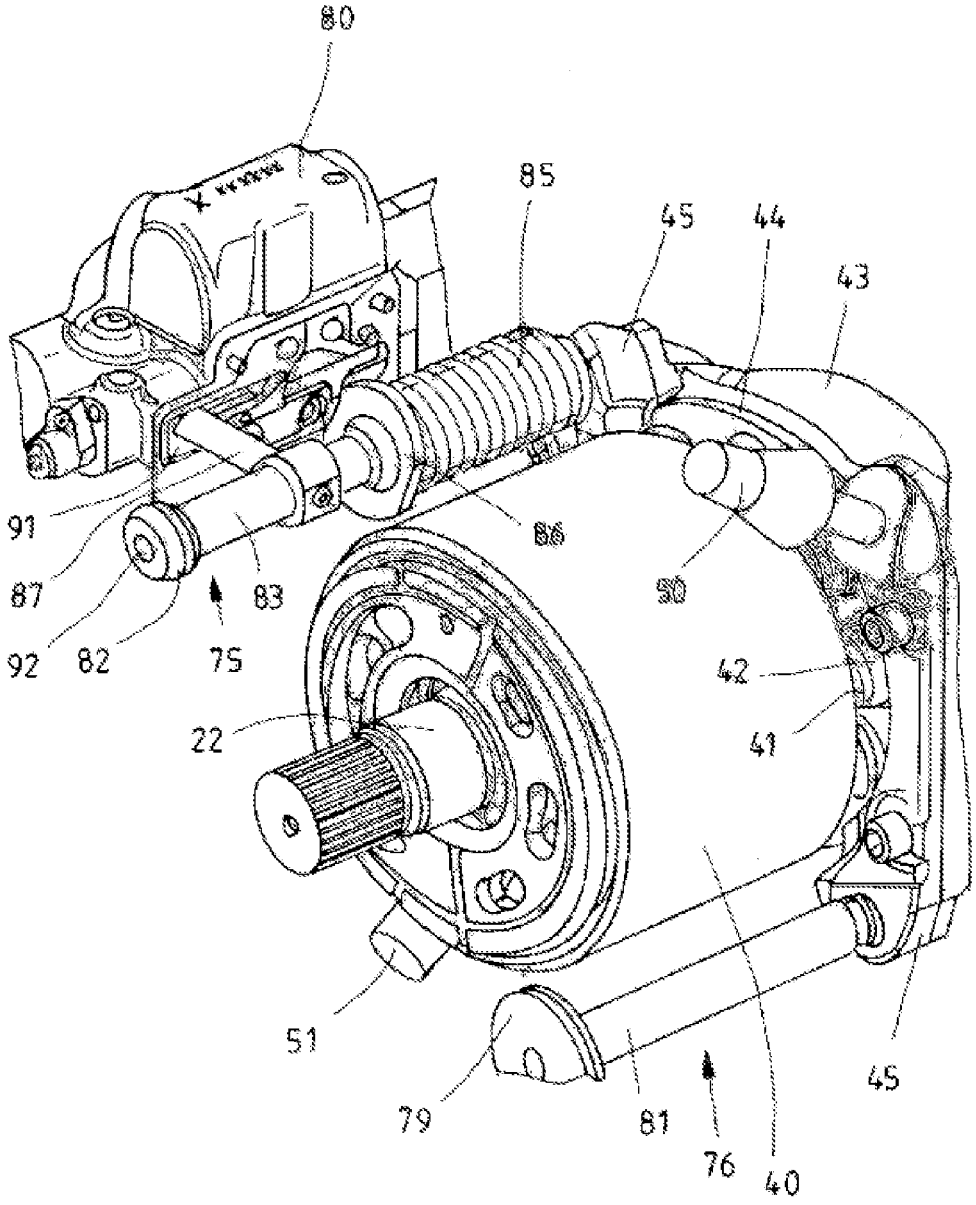
FIG. 4 shows a perspective view of an arrangement of drive unit, actuating piston and a regulating valve of the component pump configured according to the disclosure.

The function of the feedback element 87 is the same as that of the feedback element 67. FIG. 4 shows the longitudinal bore 92 in the pivoting-out piston 75, via which longitudinal bore a small piston situated in the housing 89 can be subjected to pump pressure.

In a manner known per se, depending on the configuration of feedback element and regulating valve, only the position of the swashplate (adjustment of swashplate proportional to a setpoint signal), or the product of the position and the pump pressure (torque regulation), is input into a controller of the regulating element via the feedback element. The latter case applies here.

Figure 5:
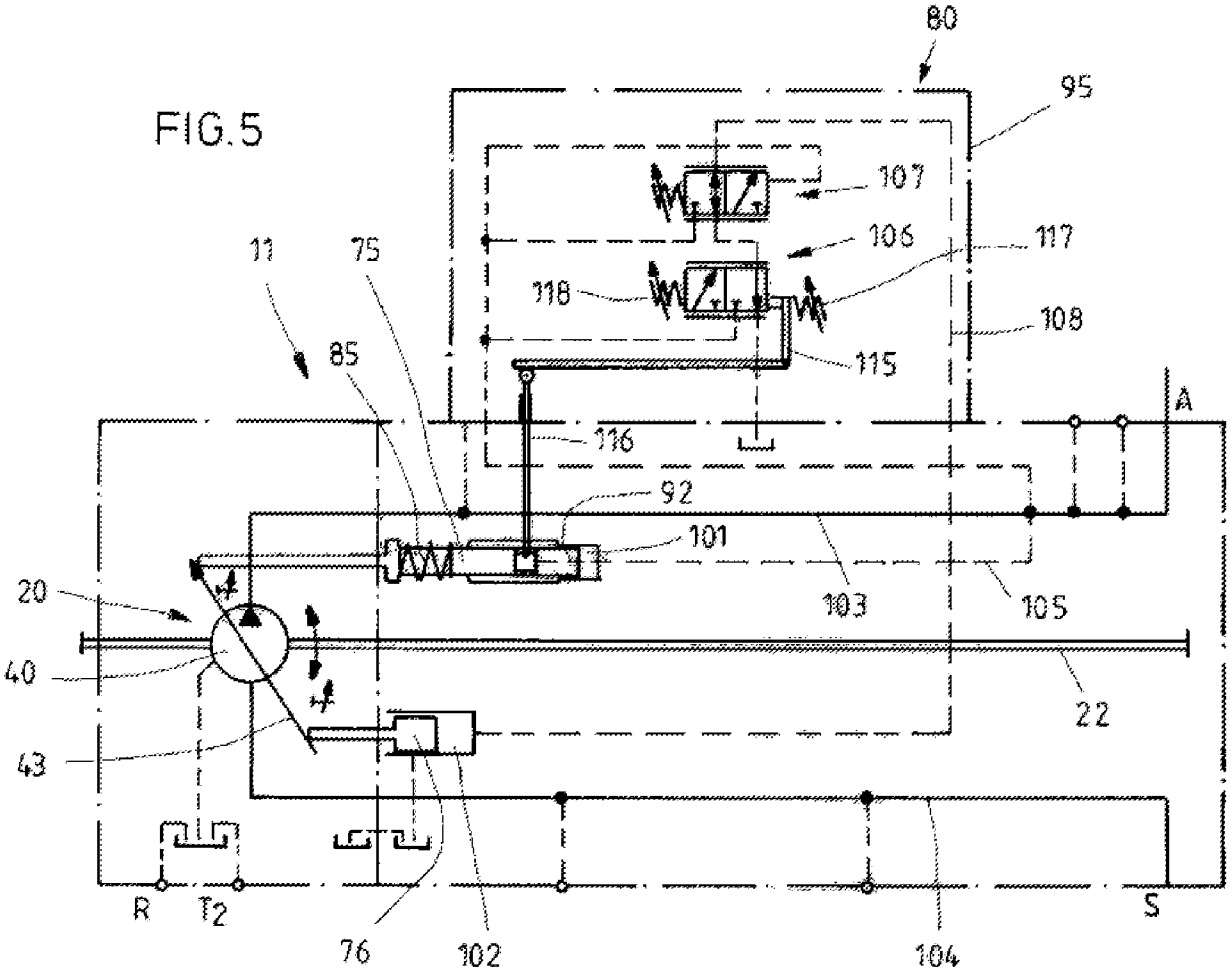
FIG. 5 shows a circuit diagram of one component pump.

More details in this regard emerge from the circuit diagram in FIG. 5, which shows an illustration of the component pump 11 of the dual pump. Said figure shows, in a housing 12, the drive unit 20 with cylinder drum 40, drive shaft 22, swashplate 43, the pivoting-out piston 75 which delimits an actuating chamber 101, the restoring spring 85 on the pivoting-out piston, and the pivoting-in piston 76 which delimits an actuating chamber 102. A high-pressure duct 103 and a low-pressure or suction duct 104 run in the housing. The actuating chamber 101 is permanently connected via a duct 105 to the high-pressure duct 103. The regulating valve 80 is constructed on the housing 12. Said regulating valve is composed of a torque-regulating component valve 106 and of a pressure-regulating component valve 107 which, when in a rest position, produces a pass-through connection, via a first input and its regulating output, between a regulating output of the component valve 106 and a control line 108 which leads to the actuating chamber 102 in the pivoting-in piston 76. A second input of the component valve 107 is connected to the high-pressure duct 103. Likewise, an input of the component valve 106 is connected to the high-pressure duct 103, while a second input of said component valve is open to the interior of the housing 12, which is at tank pressure. A regulating piston of the component valve 107 is loaded in a direction for a decrease in the pivot angle of the swashplate 43 by the pressure in the high-pressure line 103, and is loaded in the opposite direction by an adjustable spring.

In the housing 95 of the valve 80 there is mounted a two-armed lever 115, one lever arm of which is acted on by the abovementioned small piston 116 which is guided in the housing 89 of the feedback element 87 and which, via the duct 105, the actuating chamber 101 and the bore 92 in the pivoting-out piston 75, is subjected to the pressure in the high-pressure duct 103. The distance by which the engagement point is remote varies with the pivot angle of the swashplate 43. The other arm of the lever is situated between one end of the regulating piston of the component valve 106 and an adjustable spring 117 which acts at least approximately oppositely on the lever arm. Furthermore, the regulating piston is loaded in the direction of the other lever arm by an adjustable spring 118. The spring 117 and the spring 118, which is set so as to be weaker than the spring 117, generate a fixed torque on the lever 115 in one direction. Via the effective surface of the small piston 116, the high pressure in the duct 103 exerts a torque on the lever 115 which opposes the fixed torque and which is dependent on the position of the pivoting-out piston 75 or generally on the pivot angle of the swashplate 43. At a given pressure, the equilibrium with the torque generated by the two springs can be maintained only at a particular pivot angle. In the event of the equilibrium being disrupted by a change in pressure, the valve piston of the component valve 106 is moved out of its regulating position, such that pressure medium flows into the actuating chamber 102 or pressure medium can flow out of the actuating chamber 102 until a different pivot angle is attained at which equilibrium between the torques acting on the lever 115 prevails again.

It is possible in FIG. 1 to see the regions of the identical housings 94 and 95 in which the two component valves 106 and 107 are accommodated. The adjusting screws 119 for the springs 117 and 118 are likewise visible in FIG. 1.

Said guidance in the slot of the regulating valve 80 and the position of the regulating valve 80 on the housing 12 have the result that, in the component pump 11, the feedback element 87 is positioned such that the longitudinal axis 88 thereof runs substantially parallel to the pivot axis 47 of the swashplate 43. The longitudinal axis 88 of the feedback element 87 and the longitudinal axis 77 of the pivoting-out piston 75 span a plane which runs parallel to the pivot axis 47 of the swashplate 43.

Since the piston collars are guided by the sleeves and the other ends of the actuating pistons are articulatedly connected to the swashplates, it is the case that, during an adjustment of the swashplates, the various actuating pistons 55, 56, 75 and 76 perform a small pivoting movement, which is superposed on the linear movement, in a plane perpendicular to the pivot axes 37 and 47 of the swashplates. The pivoting movement also has an effect on the position of the feedback elements.

The feedback element 67 of the component pump 10 can be guided precisely with its dihedron 70 in a slot, which corresponds to the slot 91, of the regulating valve 60, because the dihedron 70 remains in the pivoting plane during a pivoting movement of the pivoting-out piston 55, and the slot is also situated in the pivoting plane. However, the position of the distal end of the feedback element in the direction of the axis 23 is determined not only by the movement component of the pivoting-out piston in said direction but rather also to a relatively great extent by the pivot angle of the pivoting-out piston. This also has an effect on the regulation. The effect is however so slight as to be insignificant in many applications.

In the case of the feedback element 87 of the component pump 11, the position of the distal end of the feedback element along the axis 23 is virtually not influenced by the pivoting of the pivoting-out piston 76. The regulation is thus more precise. However, the guide for the feedback element 87 must now be configured such that the pivoting-out piston 75 can pivot without constraint. In the present case, this is achieved by virtue of the width of the slot 91 being greater than the thickness of the dihedron 90 to such an extent that the feedback element 87 can jointly participate in the entire upward and downward movement of the pivoting-out piston 75 without a change in direction. Since the width of the slot 91 is slightly greater than the thickness of the dihedron 90, the longitudinal axis 88 of the feedback element 87 can deviate slightly from parallelism with respect to the pivot axis 47 of the swashplate 43.

Since it is sought to use two identical regulating valves 60, the width of the corresponding slot in the valve 60 is equal to the width of the slot 91 in the valve 80. Likewise, the dihedron 70 is of equal thickness to the dihedron 90. The further guidance between the slot in the valve 60 and the feedback element 67 has no effect on regulation quality.

It would also be possible to select a smaller width of the slot 91 and a smaller thickness of the dihedron 90, such that the pivoting-out piston 75, during an adjustment, also performs a small rotational movement about its axis 77. It is finally also conceivable for the slot 91 to be slightly curved so as to correspond exactly to the movement path of the feedback element 87, and for the guide surfaces on the feedback element to be configured correspondingly. The guidance could then be precise, and the feedback element would reliably maintain its orientation.

The different orientation of the two feedback elements 67 and 87 when the two pivoting-out pistons 55 and 75 are in an aligned arrangement is associated with an offset arrangement of the two valves 60 and 80. For this purpose, the housing main part has a first mounting surface 125, which is oriented perpendicular to the longitudinal axis 68 of the feedback element 67, and a second mounting surface 126, which is oriented perpendicular to the longitudinal axis 88 of the feedback element 87. The spacing of the plane in which the mounting surface 126 is situated from the axis 23 is slightly larger than the spacing of the plane in which the mounting surface 125 is situated from the axis 23. Correspondingly, the feedback element 87 is slightly longer than the feedback element 67. This permits the offset mounting despite different spatial requirements in the different directions within the housing 12.

It can now be seen from FIG. 1 that the axes of the two component valves 106 of the two regulating valves 60 and 80 are angularly offset with respect to one another to a considerable extent about the axis 23. Also, the two adjusting screws 119 which are situated at the ends, which face toward one another, of the component valves 106 are thus readily accessible. The adjustment of the corresponding springs (see FIG. 5) poses no difficulties. Here, "valve axis" is to be understood physically to mean a valve bore with a valve piston situated therein, and is to be understood geometrically to mean the central axis of said parts.

The invention claimed is:

1. A hydraulic dual axial piston machine comprising:

a first drive unit and a second drive unit arranged back-to-back in a direction of a drive shaft axis so as to be oriented oppositely to one another, wherein the first drive unit includes:

a first swashplate configured to pivot about a first pivot axis to vary an inclination relative to the drive shaft axis; and a single first actuating piston, which extends at least approximately parallel to the drive shaft axis and has a first end configured to engage on the first swashplate to pivot the first swashplate in a first direction and has a second opposite end configured to delimit a first actuating chamber into which control fluid flows to pivot the first swashplate in the first direction and out of which control fluid is displaced in the event of a pivoting movement of the first swashplate in a second direction, wherein the second drive unit includes:

a second swashplate configured to pivot about a second pivot axis which is parallel to the first pivot axis to vary an inclination relative to the drive shaft axis; and a single second actuating piston, which extends at least approximately parallel to the drive shaft axis and has a third end configured to engage on the second swashplate to pivot the second swashplate in a functionally identical manner to the first actuating piston on the first swashplate and has a fourth opposite end configured to delimit a second actuating chamber into which control fluid flows to pivot the second swashplate in a third direction and out of which control fluid is displaced in the event of a pivoting movement of the second swashplate in a fourth direction, wherein the first swashplate and the second swashplate define a central plane which is perpendicular to the first pivot axis and the second pivot axis and which extends through the drive shaft axis, and wherein the first actuating piston and the second actuating piston are arranged so as to be spaced apart from the central plane at least approximately in alignment with one another.

2. The hydraulic dual axial piston machine as claimed in claim 1, wherein:

the first drive unit has a first pivoting-out piston and a first pivoting-out actuating chamber to which control fluid is supplied when the first swashplate is pivoted in the first direction, the first drive unit has a first pivoting-in piston and a first pivoting-in actuating chamber to which control fluid is supplied when the first swashplate is pivoted in the second direction, the second drive unit has a second pivoting-out piston and a second pivoting-out actuating chamber to which control fluid is supplied when the second swashplate is pivoted in the third direction, the second drive unit has a second pivoting-in piston and a second pivoting-in actuator chamber to which control fluid is supplied when the second swashplate is pivoted in the fourth direction, the first and second pivoting-out pistons are arranged in alignment with one another, and the first and second pivoting-in pistons are arranged in alignment with one another.

3. The hydraulic dual axial piston machine as claimed in claim 1, further comprising:

a first regulating valve having a first controller and a second regulating valve having a second controller;

a first elongate feedback element arranged on the single first actuating piston and configured to input a position of the single first actuating piston and thus a pivot angle of the first swashplate into the first controller; and a second elongate feedback element arranged on the single second actuating piston and configured to input a position of the single second actuating piston and thus a pivot angle of the second swashplate into the second controller, wherein:

the first elongate feedback element and the second elongate feedback element are situated such that a longitudinal axis of the first elongate feedback element and a longitudinal axis of the single first actuating piston span a first plane and a longitudinal axis of the second elongate feedback element and a longitudinal axis of the single second actuating piston span a second plane which differs from the first plane.

4. The hydraulic dual axial piston machine as claimed in claim 3, wherein the first elongate feedback element and the second elongate feedback element are situated such that the first plane and the second plane are at least approximately perpendicular to one another.

5. The hydraulic dual axial piston machine as claimed in claim 4, wherein the first plane is perpendicular to the first and second pivot axes and the second plane is parallel to the first and second pivot axes.

6. A hydraulic dual axial piston machine comprising: a first drive unit and a second drive unit arranged back-to-back in a direction of a drive shaft axis so as to be oriented oppositely to one another; and a first regulating valve having a first controller and a second regulating valve having a second controller; wherein the first drive unit includes: a first swashplate configured to pivot about a first pivot axis to vary an inclination relative to the drive shaft axis; and a single first actuating piston, which extends at least approximately parallel to the drive shaft axis and has a first end configured to engage on the first swashplate to pivot the first swashplate in a first direction and has a second opposite end configured to delimit a first actuating chamber into which control fluid flows to pivot the first swashplate in the first direction and out of which control fluid is displaced in the event of a pivoting movement of the first swashplate in a second direction, wherein the second drive unit includes: a second swashplate configured to pivot about a second pivot axis which is parallel to the first pivot axis to vary an inclination relative to the drive shaft axis; and a single second actuating piston, which extends at least approximately parallel to the drive shaft axis and has a third end configured to engage on the second swashplate to pivot the second swashplate in a functionally identical manner to the first actuating piston on the first swashplate and has a fourth opposite end configured to delimit a second actuating chamber into which control fluid flows to pivot the second swashplate in a third direction and out of which control fluid is displaced in the event of a pivoting movement of the second swashplate in a fourth direction, wherein the first swashplate and the second swashplate define a central plane which is perpendicular to the first pivot axis and the second pivot axis and which extends through the drive shaft axis, wherein the first actuating piston and the second actuating piston are arranged so as to be spaced apart from the central plane at least approximately in alignment with one another, wherein the piston machine further comprises a first elongate feedback element arranged on the single first actuating piston and configured to input a position of the single first actuating piston and thus a pivot angle of the first swashplate into the first controller; and wherein the piston machine further comprises a second elongate feedback element arranged on the single second actuating and configured to input a position of the single second actuating piston and thus a pivot angle of the second swashplate into the second controller, wherein the first elongate feedback element and the second elongate feedback element are situated such that a longitudinal axis of the first elongate feedback element and a longitudinal axis of the single first actuating piston span a first plane and a longitudinal axis of the second elongate feedback element and a longitudinal axis of the single second actuating piston span a second plane which differs from the first plane, and wherein the first and second elongate feedback elements have different lengths.

7. The hydraulic dual axial piston machine as claimed in claim 3, further comprising:

a housing having an outside with a first mounting surface and a second mounting surface, wherein:

the first regulating valve is attached to the first mounting surface with an offset in the direction of the drive shaft axis, the second regulating valve is attached to the second mounting surface, and the first mounting surface is rotated relative to the second mounting surface about the drive shaft axis.

8. The hydraulic dual axial piston machine as claimed in claim 7, wherein:

the first mounting surface is arranged in a third plane that is parallel to the drive shaft axis and is spaced apart from the drive shaft axis by a first distance, the second mounting surface is arranged in a fourth plane that is parallel to the drive shaft axis and is and spaced apart from the drive shaft axis by a second distance, which is different from the first distance.

9. The hydraulic dual axial piston machine as claimed in claim 7, wherein:

the first mounting surface is parallel to the first and second pivot axes and to the drive shaft axis, and the second mounting surface is perpendicular to the first and second pivot axes.

10. The hydraulic dual axial piston machine as claimed claim 7, wherein:

the first mounting surface is at least approximately perpendicular to the longitudinal axis of the first elongate feedback element, the second mounting surface is at least approximately perpendicular to the longitudinal axis of the second elongate feedback element, and equivalent valve axes of the first and second regulating valves are offset with respect to one another in a circumferential direction of the housing.

11. The hydraulic axial piston machine as claimed in claim 1, wherein the single first actuating piston and the single second actuating piston are both configured as pivoting-in pistons.

12. The hydraulic axial piston machine as claimed in claim 1, wherein the single first actuating piston and the single second actuating piston are both configured as pivoting-out pistons.

* * * * *